US012704126B2

(12) United States Patent
Mashiyama et al.

(10) Patent No.: US 12,704,126 B2
(45) Date of Patent: Aug. 11, 2026

(54) SCROLL COMPRESSOR

(71) Applicant: SANDEN CORPORATION, Gunma (JP)

(72) Inventors: Hiroki Mashiyama, Gunma (JP); Yuta Tanaka, Gunma (JP); Taizo Sato, Gunma (JP); Kyoshiro Nishiyama, Gunma (JP); Hitoshi Akuzawa, Gunma (JP); Misako Kaburagi, Gunma (JP); Eiichi Oshio, Gunma (JP)

(73) Assignee: SANDEN CORPORATION, Gunma (JP)

( * ) Notice: Subject to any disclaimer, the term of this patent is extended or adjusted under 35 U.S.C. 154(b) by 0 days.

(21) Appl. No.: 19/103,260

(22) PCT Filed: Jul. 27, 2023

(86) PCT No.: PCT/JP2023/027534
§ 371 (c)(1),
(2) Date: Feb. 12, 2025

(87) PCT Pub. No.: WO2024/042989
PCT Pub. Date: Feb. 29, 2024

(65) Prior Publication Data

US 2026/0055765 A1 Feb. 26, 2026

(30) Foreign Application Priority Data

Aug. 24, 2022 (JP) ..... 2022-132922

(51) Int. Cl.
*F04C 18/02* (2006.01)

(52) U.S. Cl.
CPC ..... *F04C 18/0276* (2013.01); *F04C 18/0215* (2013.01); *F04C 18/0284* (2013.01)

(58) Field of Classification Search
CPC ..... F04C 18/0215; F04C 18/0284; F04C 18/0276
See application file for complete search history.

(56) References Cited

U.S. PATENT DOCUMENTS 4,457,674 A * 7/1984 Kawano ..... F04C 18/0276 418/5
4,548,555 A * 10/1985 Hiraga ..... F01C 1/0246 418/55.2

(Continued)

FOREIGN PATENT DOCUMENTS

DE 102013004492 A1 * 9/2013 ..... F04C 27/02
EP 3438458 A1 * 2/2019 ..... F04C 27/005

(Continued)

OTHER PUBLICATIONS

International Search Report dated Oct. 10, 2023 filed in PCT/JP2023/027534.

*Primary Examiner* — Alexander B Comley
(74) *Attorney, Agent, or Firm* — Rankin, Hill & Clark LLP

(57) ABSTRACT

Provided is a scroll compressor with durability improved by effectively reducing strong contact between a wrap of a movable scroll and an end plate of a fixed scroll without impairing a function. A compression chamber 34 formed between wraps 24, 32 of a fixed scroll 21 and a movable scroll 22 is narrowed while moving from the outside to the inside, thereby compressing working fluid. The wrap 32 of the movable scroll 22 has an inclined portion of which a height gradually decreases toward a winding end point P2 in an area from a point P1 at which a line L1 extending outward from the center O of a spiral base circle through an outer wall extension start point S intersects the outermost wrap 32 to the winding end point P2.

5 Claims, 2 Drawing Sheets

(56) References Cited

U.S. PATENT DOCUMENTS

| | | | | | |
|---|---|---|---|---|---|
| 5,496,161 | A * | 3/1996 | Machida | F04C 18/0276 | 418/83 |
| 5,584,677 | A * | 12/1996 | Ishikawa | F04C 18/0253 | 418/178 |
| 5,857,844 | A * | 1/1999 | Lifson | F04C 18/0276 | 418/57 |
| 8,007,261 | B2 * | 8/2011 | Caillat | F04C 27/005 | 418/179 |
| 10,968,908 | B2 * | 4/2021 | Sato | F04C 18/0284 | |
| 11,047,384 | B2 * | 6/2021 | Nakai | F04C 18/0215 | |
| 11,326,601 | B2 * | 5/2022 | Sato | F04C 18/0215 | |
| 2002/0054821 | A1 * | 5/2002 | Takeuchi | F04C 18/0269 | 418/55.4 |
| 2014/0271304 | A1 * | 9/2014 | Jin | F04C 28/26 | 418/55.4 |
| 2015/0118090 | A1 * | 4/2015 | Lachey | F04B 39/005 | 428/639 |
| 2021/0071662 | A1 * | 3/2021 | Sato | F04C 18/0276 | |

FOREIGN PATENT DOCUMENTS

| | | | | | |
|---|---|---|---|---|---|
| JP | 59-068583 | A | | 4/1984 | |
| JP | S5968583 | A | * | 4/1984 | F01C 1/0246 |
| JP | S61105785 | U | * | 7/1986 | |
| JP | H07109982 | A | * | 4/1995 | F01C 19/08 |
| JP | 2002031069 | A | * | 1/2002 | |
| JP | 2005163745 | A | * | 6/2005 | |
| JP | 4545039 | B2 | * | 9/2010 | |
| JP | 4576306 | B2 | * | 11/2010 | F04C 18/088 |
| JP | 2013144940 | A | * | 7/2013 | F04C 18/0284 |
| JP | 6021373 | B2 | * | 11/2016 | F04C 18/02 |
| JP | 2018028302 | A | * | 2/2018 | F04C 27/005 |
| JP | 6336530 | B2 | * | 6/2018 | F04C 18/02 |
| JP | 2019143547 | A | * | 8/2019 | F01C 1/02 |
| JP | 2019143548 | A | * | 8/2019 | F04C 29/042 |
| JP | 2019143549 | A | * | 8/2019 | F04C 27/001 |
| JP | 7134641 | B2 | * | 9/2022 | |
| KR | 20130094124 | A | * | 8/2013 | C23C 18/48 |

* cited by examiner

SCROLL COMPRESSOR

TECHNICAL FIELD

The present invention relates to a scroll compressor that compresses working fluid in a compression chamber formed between wraps of a movable scroll and a fixed scroll by revolving the movable scroll relative to the fixed scroll.

BACKGROUND ART

Conventionally, the scroll compressor of this type includes a compression mechanism having a fixed scroll with a spiral wrap on a face of an end plate and a movable scroll with a spiral wrap on a face of an end plate. The scroll compressor is configured such that a compression chamber is formed between the wraps of the scrolls by making these wraps face each other and the movable scroll is revolved relative to the fixed scroll by a motor and is moved from the outside to the inside while the volume of the compression chamber decreases. In this manner, the scroll compressor compresses working fluid (refrigerant).

In this case, conventionally, a tip seal made of a resin material is attached to the distal ends of the wraps of both the fixed scroll and the movable scroll or to one of these distal ends to prevent contact of metal (aluminum). However, in a case where the tip seals are not provided, in an operating state in which the scroll compressor repeatedly stops and restarts, the movable scroll starts while overturning (tilting). Therefore, it is conceivable that the distal end of the wrap of the movable scroll contacts the end plate of the fixed scroll very strongly until the start is stabilized. In particular, in the vicinity of a winding end at which the wall thickness of the wrap is thin and a surface pressure is likely to increase, a drag groove may be formed in the end plate of the fixed scroll.

When such a state is repeated, there is a problem that plating is abraded at the distal end of the movable scroll in the vicinity of the wrap winding end, strong contact resistance is generated between the metal scrolls, and fatigue fracture (wall cracking or fracture) occurs due to a load.

CITATION LIST

Patent Literature

Patent Literature 1: Japanese Patent No. 4545039

SUMMARY OF INVENTION

Problems to be Solved by Invention

Therefore, for example, it is conceivable to lower a winding end portion of the wrap of the movable scroll in a stepwise manner, but there is a disadvantage that the surface pressure increases at a corner portion of a joint of steps and partial peeling of the plating is caused.

It is also conceivable to gradually lower the outermost height of the wrap of the movable scroll as in Patent Literature 1, for example. However, in Patent Literature 1, an area where the height of the wrap is lowered is not clear, and if the area is too wide, the function as the scroll compressor is impaired. On the other hand, if the area is too narrow, it is not possible to cope with actual wear of the scroll, and occurrence of a strong contact state cannot be effectively reduced. Thus, durability is impaired.

The present invention has been made in order to solve the conventional technical problems, and an object of the present invention is to provide a scroll compressor with durability improved by effectively reducing strong contact between a wrap of a movable scroll and an end plate of a fixed scroll without impairing a function.

Solution to Problems

A scroll compressor of the present invention includes a compression mechanism having a fixed scroll and a movable scroll formed with opposing spiral wraps on faces of end plates, the movable scroll revolves relative to the fixed scroll and a compression chamber formed between the wraps of both the scrolls is narrowed while moving from the outside to the inside, thereby compressing working fluid, and the wrap of the movable scroll has an inclined portion of which the height gradually decreases toward a winding end point P2 in an area from a point P1 at which a line L1 extending outward from the center of a spiral base circle through an outer wall extension start point intersects the outermost wrap to the winding end point P2.

The scroll compressor of tone embodiment of the present application is the above-described invention in which a first inclined portion of which the height gradually decreases toward the winding end point P2, a flat portion of which the height does not change, and a second inclined portion of which the height gradually decreases toward the winding end point P2 are continuously formed in the wrap of the movable scroll in the area.

The scroll compressor of one embodiment of the present application is the above-described invention in which the height of the wrap of the movable scroll decreases by 10 μm at the end point of the first inclined portion and decreases by 50 μm at the end point of the second inclined portion.

The scroll compressor of one embodiment of the present application is the above-described invention in which the length of the wrap of the movable scroll is set to be longer in the flat portion than in the first inclined portion and to be longer in the second inclined portion than in the flat portion.

The scroll compressor of one embodiment of the present application is the above-described invention in which both the scrolls are plated.

The scroll compressor of one embodiment of the present application is the above-described invention in which a back pressure chamber is formed in the back of the end plate of the movable scroll, and a back pressure hole causing the back pressure chamber and the compression chamber to communicate with each other is formed so as to penetrate the end plate of the movable scroll.

The scroll compressor of one embodiment of the present application is each of the above-described inventions in which no tip seal is provided at the distal ends of the wraps of the fixed scroll and the movable scroll.

Effects of Invention

According to the present invention, it is possible to improve drag of the end plate of the fixed scroll while maintaining the function as the scroll compressor, to effectively prevent occurrence of fatigue fracture at the distal end of the movable scroll in the vicinity of the winding end of the wrap, and to improve durability. Accordingly, it is possible to provide the scroll compressor with both the function and the durability.

DESCRIPTION OF EMBODIMENTS

Figure 1:
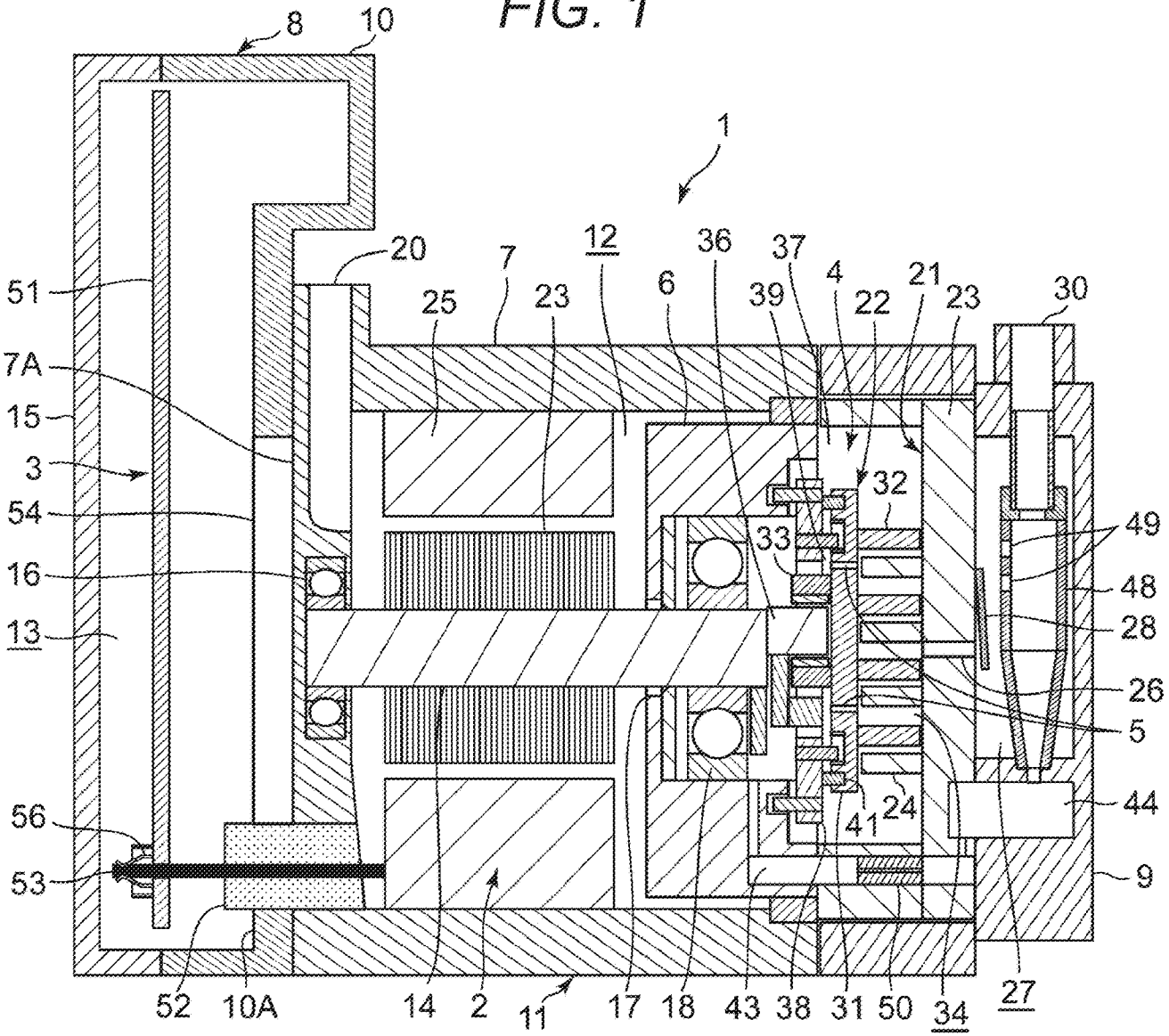
FIG. 1 is a longitudinal sectional view of a scroll compressor of an embodiment to which the present invention is applied.

Hereinafter, embodiments of the present invention will be described in detail with reference to the drawings. FIG. 1 is a schematic sectional view of a scroll compressor 1 according to an embodiment to which the present invention is applied.

The scroll compressor 1 of the embodiment is used, for example, in a refrigerant circuit of an air-conditioning device for an electric vehicle, and sucks and compresses refrigerant as working fluid for the air-conditioning device, and discharges the refrigerant into a discharge pipe. The scroll compressor 1 is what is called a horizontal inverter-integrated scroll compressor including a three-phase electric motor 2, an inverter 3 for operating the electric motor 2, and a scroll compression mechanism 4 as a compression mechanism driven by the electric motor 2.

The scroll compressor 1 of the embodiment includes a stator housing 7 accommodating the electric motor 2 and a center casing 6 therein, an inverter case 8 attached to a one-end-side end wall 7A of the stator housing 7 and accommodating the inverter 3 therein, and a rear casing 9 attached to the other end side of the stator housing 7.

The stator housing 7, the inverter case 8, and the rear casing 9 are all made of metal (aluminum in the embodiment), and are integrally joined to form a housing 11 of the scroll compressor 1 of the embodiment.

A motor chamber 12 accommodating the electric motor 2 is formed in the stator housing 7, and one end face of the motor chamber 12 is closed basically with the end wall 7A of the stator housing 7. The end wall 7A serves as a partition wall defining the motor chamber 12 and an inverter housing portion 13 to be described below. The other end face of the motor chamber 12 is opened, and the center casing 6 is accommodated in the opening after the electric motor 2 has been accommodated. Moreover, a secondary bearing 16 for rotatably supporting one end portion of a drive shaft 14 of the electric motor 2 is attached on the inner face (motor chamber 12 side) of the end wall 7A.

The center casing 6 is opened on a side (other end side) opposite to the electric motor 2. After a movable scroll 22, which will be described below, of the scroll compression mechanism 4 has been accommodated, the rear casing 9 to which a fixed scroll 21, which will also be described below, of the scroll compression mechanism 4 is fixed is fixed to the stator housing 7 to thereby close the opening.

Moreover, a through-hole 17 into which the other end portion of the drive shaft 14 of the electric motor 2 is inserted is opened in the center casing 6, and a main bearing 18 rotatably supporting the other end portion of the drive shaft 14 on the scroll compression mechanism 4 side is attached on the scroll compression mechanism 4 side of the through-hole 17 in the center casing 6.

The electric motor 2 includes a stator 25 around which a coil is wound and which is fixed to the inside of a peripheral wall of the stator housing 7, and a rotor 23 that rotates inside the stator 25. In addition, it is configured in such a manner that, for example, direct current from a battery (not illustrated) of the vehicle is converted into three-phase alternating current by the inverter 3 to be supplied to the coil of the stator 25 of the electric motor 2, and therefore, the rotor 23 is rotationally driven. In addition, the drive shaft 14 is fixed to the rotor 23.

Moreover, a suction port 20 is formed in the stator housing 7, and the refrigerant sucked through the suction port 20 passes through the electric motor 2 in the stator housing 7, then flows into the center casing 6, and is sucked into a suction portion 37 outside the scroll compression mechanism 4. Consequently, the electric motor 2 is cooled by the sucked refrigerant. Moreover, it is configured in such a manner that the refrigerant compressed by the scroll compression mechanism 4 is discharged from a discharge chamber 27 to be described below into the discharge pipe of the refrigerant circuit (not illustrated) outside the housing 11 through a discharge port 30 formed in the rear casing 9.

The scroll compression mechanism 4 includes the above-described fixed scroll 21 and movable scroll 22. The fixed scroll 21 integrally includes a disk-shaped end plate 23, and a wrap 24 erected on a face (one face) of the end plate 23, the wrap 24 having an involute shape or a spiral shape formed of a curve close to the involute shape, and being fixed to the rear casing 9 with the face, on which the wrap 24 is erected, of the end plate 23 facing the center casing 6.

Note that a tip seal is not provided at the distal end of the wrap 24 of the fixed scroll 21 of the embodiment. In addition, tin plating is applied to the faces of the end plate 23 and the wrap 24 in the embodiment. In the center of the end plate 23 of the fixed scroll 21, a discharge hole 26 is formed, and the discharge hole 26 communicates with the discharge chamber 27 in the rear casing 9. In the drawing, reference numeral 28 denotes a discharge valve provided at an opening of the discharge hole 26 on the back (other face) side of the end plate 23.

The movable scroll 22 is a scroll that revolves relative to the fixed scroll 21, and integrally includes a disk-shaped end plate 31, a wrap 32 erected on a face (one face) of the end plate 31, the wrap 32 having an involute shape or a spiral shape formed of a curve close to the involute shape, and a boss 33 protruding from the center of the back (other face) of the end plate 31.

Note that a tip seal is not also provided at the distal end of the wrap 32 of the movable scroll 22 of the embodiment. In addition, electroless nickel-phosphorus plating is applied to the faces of the end plate 31 and the wrap 32 in the embodiment. The movable scroll 22 is placed in such a manner that the wrap 32 faces and meshes with the wrap 24 of the fixed scroll 21 with the protruding direction of the wrap 32 facing the fixed scroll 21, and a compression chamber 34 is formed between the wraps 24, 32.

In other words, the wrap 32 of the movable scroll 22 faces the wrap 24 of the fixed scroll 21, and meshes with the wrap 24 of the fixed scroll 21 in such a manner that the distal end of the wrap 32 is in contact with the face of the end plate 23 and the distal end of the wrap 24 is in contact with the face of the end plate 31, and an eccentric portion 36 provided at the other end of the drive shaft 14 in such a manner as to be eccentric to the axis is fitted in the boss 33 of the movable scroll 22. In addition, it is configured in such a manner that when the drive shaft 14 is rotated together with the rotor 23 of the electric motor 2, then the movable scroll 22 revolves relative to the fixed scroll 21 without rotating on its axis.

Since the movable scroll 22 eccentrically revolves relative to the fixed scroll 21, the eccentric direction and contact position of each of the wraps 24, 32 move during rotation, and the compression chamber 34 having sucked the refrigerant from the above-described suction portion 37 on the outside is gradually narrowed while moving inward. As a result, the refrigerant is compressed and finally discharged from the central discharge hole 26 to the discharge chamber 27 via the discharge valve 28.

In FIG. 1, reference numeral 38 denotes an annular thrust plate. The thrust plate 38 sections a back pressure chamber 39 formed between the back of the end plate 31 of the movable scroll 22 and the center casing 6, and the suction portion 37 outside the scroll compression mechanism 4, and is located outside the boss 33 and interposed between the center casing 6 and the movable scroll 22. Moreover, reference numeral 41 denotes a sealing member attached to the back of the end plate 31 of the movable scroll 22 and contacting the thrust plate 38. The sealing member 41 and the thrust plate 38 section the back pressure chamber 39 and the suction portion 37.

Moreover, reference numeral 48 denotes a centrifugal oil separator attached in the discharge chamber 27 of the rear casing 9 (housing 11). The oil separator 48 separates lubricating oil mixed in the refrigerant discharged from the scroll compression mechanism 4 into the discharge chamber 27, from the refrigerant. The oil separator 48 is formed with an inflow port 49, and the refrigerant containing the oil, which has flowed in through the inflow port 49, swirls in the oil separator 48. The oil is separated by the centrifugal force at this time, and the refrigerant flows from an outflow port at the upper end toward the discharge port 30, and is discharged into the discharge pipe as described above.

The rear casing 9 is formed with an oil reservoir 44 below the oil separator 48, and the oil separated from the refrigerant by the oil separator 48 flows into the oil reservoir 44 from the lower end of the oil separator 48. In the drawing, reference numeral 43 denotes a back pressure passage formed from the rear casing 9 to the center casing 6. The back pressure passage 43 is a path which causes the oil separator 48 in the discharge chamber 27 (discharge side of the scroll compression mechanism 4) in the rear casing 9 to communicate with the back pressure chamber 39, and has an orifice 50 in the embodiment. As a result, the back pressure chamber 39 is configured in such a manner that discharge pressure adjusted and reduced by the orifice 50 of the back pressure passage 43 is supplied to the back pressure chamber 39 together with the oil in the oil reservoir 44, which has been separated by the oil separator 48.

The pressure (back pressure) in the back pressure chamber 39 generates a back pressure load which presses the movable scroll 22 against the fixed scroll 21. Under the back pressure load, the movable scroll 22 is pressed against the fixed scroll 21 against compression reaction force from the compression chamber 34 of the scroll compression mechanism 4, the contact between the wraps 24, 32 and the end plates 31, 23 is maintained, and the refrigerant can be compressed in the compression chamber 34.

The end plate 31 of the movable scroll 22 is provided with back pressure holes 5 causing the back pressure chamber 39 and a compression chamber 34 to communicate with each other at two locations in the embodiment. Each back pressure hole 5 plays a role of releasing pressure (refrigerant and oil) from the back pressure chamber 39 to the compression chamber 34 when the pressure (back pressure) in the back pressure chamber 39 becomes excessive.

On the other hand, the inverter case 8 includes a case body 10 forming the inverter housing portion 13 in which the inverter 3 is accommodated, and a lid member 15 closing an opening of one end face of the case body 10. The lid member 15 is attached to the case body 10 after the inverter 3 has been accommodated in the inverter housing portion 13.

A hermetic plate 52 is attached to the end wall 7A (partition wall) of the stator housing 7, and a conductive hermetic pin 53 is attached to the hermetic plate 52. One end side of the hermetic pin 53 penetrates the end wall 7A into the motor chamber 12, and is connected to the coil of the stator 25 of the electric motor 2. The other end side of the hermetic pin 53 is electrically connected to a circuit board 51 via a press-fit terminal 56.

Figure 2:
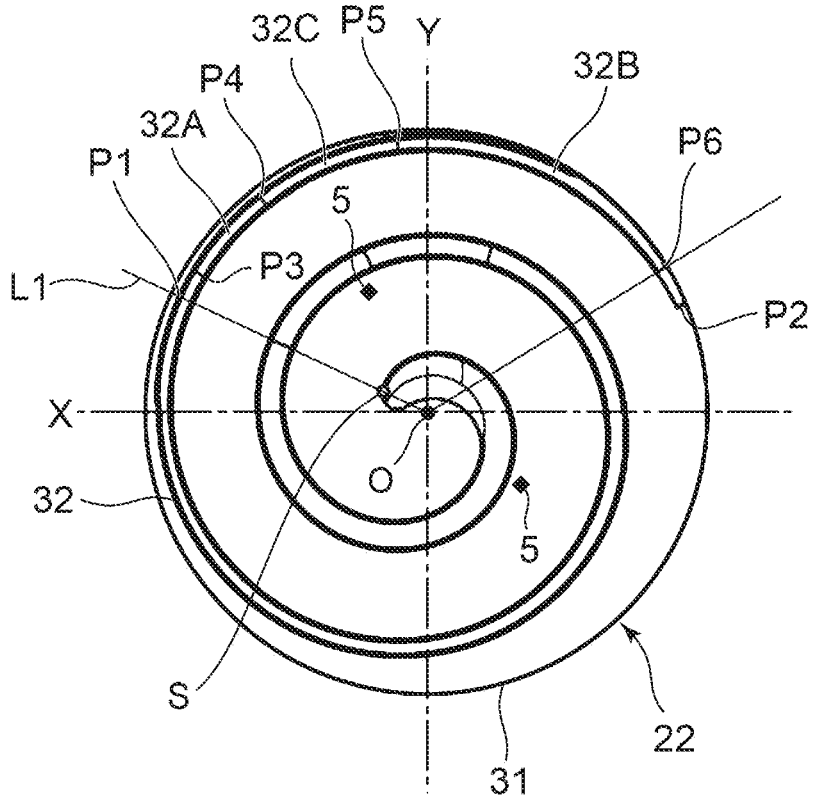
FIG. 2 is a plan view of a movable scroll of the scroll compressor of FIG. 1 as viewed from a wrap side.

Next, the shape of the distal end portion of the wrap 32 of the movable scroll 22 of the embodiment will be described in detail with reference to FIGS. 2 and 3. FIG. 2 is a plan view of the movable scroll 22 as viewed from the wrap 32 side (front side), and FIG. 3 is a view for explaining the height of the wrap 32 in the vicinity of a winding end.

In FIG. 2, O denotes the center of a spiral base circle of the wrap 32 of the movable scroll 22, and S denotes an outer wall extension start point of the wrap 32. When a line extending from the center O of the spiral base circle toward the outside of the movable scroll 22 through the outer wall extension start point S is defined as L1, a point at which the line L1 intersects the outermost wrap 32 is defined as P1. Moreover, P2 denotes a winding end point of the wrap 32.

In the present invention, the wrap 32 is formed with an inclined portion of which the height gradually decreases toward the winding end point P2 in an area from the point P1 to the winding end point P2. In the case of the embodiment, as the inclined portion, a first inclined portion 32A of which the height gradually decreases toward the winding end point P2 and a second inclined portion 32B of which the height also gradually decreases toward the winding end point P2 are provided, and a flat portion 32C of which the height does not change is provided between the first and second inclined portions 32A, 32B. That is, in the wrap 32 of the embodiment, the first inclined portion 32A, the flat portion 32C, and the second inclined portion 32B are continuously formed from the point P1 side in an area from the point P1 to the winding end point P2.

Figure 3:
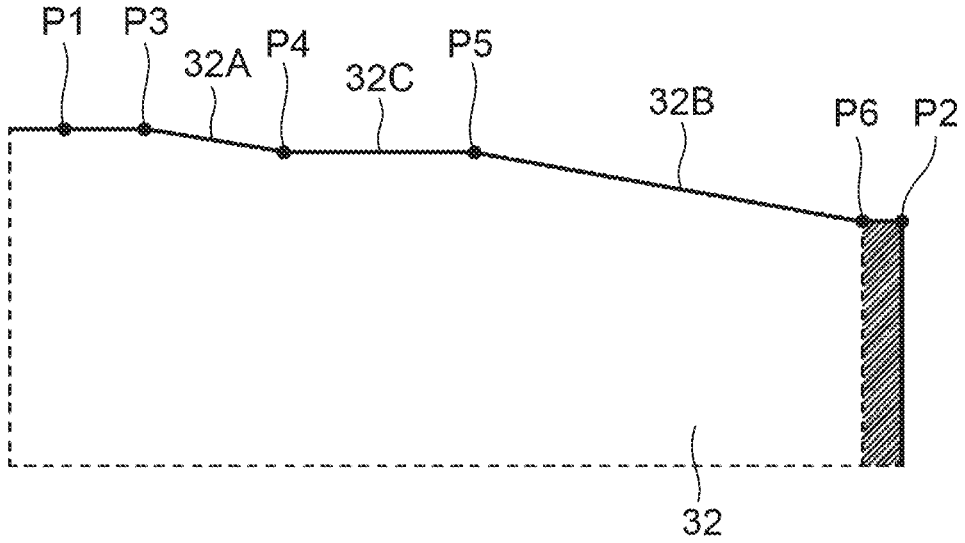
FIG. 3 is a view for explaining a wrap height in the vicinity of the winding end of the movable scroll of FIG. 2.

In addition, as illustrated in FIG. 3, when the start point of the first inclined portion 32A is P3, the end point of the first inclined portion 32A, i.e., the start point of the flat portion 32C, is P4, the end point of the flat portion 32C, i.e., the start point of the second inclined portion 32B, is P5, and the end point of the second inclined portion 32B is P6, the length of the wrap 32 has a relationship of the length of the first inclined portion 32A from P3 to P4<the length of the flat portion 32C from P4 to P5<the length of the second inclined portion 32B from P5 to P6.

That is, the length of the wrap 32 of the movable scroll 22 is set to be longer in the flat portion 32C than in the first inclined portion 32A and to be longer in the second inclined portion 32B than in the flat portion 32C. Further, in the embodiment, the height of the wrap 32 of the movable scroll 22 is 10 μm lower than the start point P3 (normal height of the wrap 32) at the end point P4 of the first inclined portion 32A (start point of the flat portion 32C), and is 50 μm lower than the start point P3 at the end point P6 of the second inclined portion 32B.

In a case where the tip seal is not provided at the distal end of the wrap 32 as in the embodiment, in the operating state in which the scroll compressor 1 repeatedly stops and restarts as described above, the movable scroll 22 starts while overturning (tilting). Therefore, the distal end of the wrap 32 of the movable scroll 22 contacts the end plate 23 of the fixed scroll 21 very strongly until the start is stabilized. Therefore, particularly in the vicinity of the winding end where the wall thickness of the wrap 32 is thin and the surface pressure is likely to increase, a drag groove is formed in the end plate 23 of the fixed scroll 21.

Therefore, if the height of the wrap 32 is lowered so as not to make strong contact, the function as the scroll compressor 1 is impaired if a height lowering range is too wide. On the other hand, if the range is too narrow, occurrence of a strong contact state between the end plate 23 of the fixed scroll 21 and the wrap 32 of the movable scroll 22 cannot be effectively reduced, and durability is impaired.

On the other hand, as in the present invention, in the wrap 32 of the movable scroll 22, in the area from the point P1 at which the line L1 extending outward from the center O of the spiral base circle through the outer wall extension start point S intersects the outermost wrap 32 to the winding end point P2, the inclined portion of which the height gradually decreases toward the winding end point P2 is formed, and in this area, the first inclined portion 32A of which the height gradually decreases toward the winding end point P2, the flat portion 32C of which the height does not change, and the second inclined portion 32B of which the height gradually decreases toward the winding end point P2 are continuously formed as in the embodiment, so that it is possible to improve the drag of the end plate 23 of the fixed scroll 21 while the function as the scroll compressor 1 is maintained and to effectively prevent occurrence of fatigue fracture at the distal end of the movable scroll 22 in the vicinity of the winding end of the wrap 32. As a result, the durability can be improved, and both the function and the durability can be achieved.

Note that in the embodiment, the first inclined portion 32A of which the height gradually decreases toward the winding end point P2, the flat portion 32C of which the height does not change, and the second inclined portion 32B of which the height gradually decreases toward the winding end point P2 are continuously formed in the wrap 32 of the movable scroll 22. However, the present invention is not limited thereto, and a series of inclined portion (with no flat portion therebetween) of which the height gradually decreases toward the winding end point P2 may be formed or more inclined portions and flat portions may be formed in addition to those of the embodiment in the area from the point P1 at which the line L1 extending outward from the center O of the spiral base circle through the outer wall extension start point S intersects the outermost wrap 32 to the winding end point P2.

In the embodiment, the present invention is applied to the scroll compressor 1 used in the refrigerant circuit of the vehicle air-conditioning device, but the present invention is not limited thereto. The present invention is effective for scroll compressors used in refrigerant circuits of various refrigeration devices. Further, in the embodiment, the present invention is applied to what is called an inverter-integrated scroll compressor, but the present invention is not limited thereto and can also be applied to a normal scroll compressor not integrally provided with an inverter.

LIST OF REFERENCE SIGNS

1 Scroll Compressor
2 Electric Motor
4 Scroll Compression Mechanism (Compression Mechanism)
5 Back Pressure Hole
11 Housing
21 Fixed Scroll
22 Movable Scroll
23, 31 End Plate
24, 32 Wrap
32A First Inclined Portion
32B Second Inclined Portion
32C Flat Portion
L1 Line Extending Outward of Movable scroll 22 from Center O of Spiral Base Circle through Outer Wall Extension Start Point S
O Center of Spiral Base Circle of Wrap 32 of Movable Scroll 22
P1 Point at which Line L1 Intersects Outermost Wrap 32
P2 Winding End Point of Wrap 32
S Outer Wall Extension Start Point of Wrap 32

The invention claimed is:

1. A scroll compressor comprising a compression mechanism including a fixed scroll comprising a disk-shaped end plate and a spiral wrap on a face of the disk-shaped end plate of the fixed scroll and a movable scroll comprising a disk-shaped end plate and a spiral wrap opposing the spiral wrap of the fixed scroll on a face of the disk-shaped end plate of the movable scroll, wherein the movable scroll revolves relative to the fixed scroll and a compression chamber formed between the wraps of both the scrolls is narrowed while moving from an outside to an inside, thereby compressing working fluid, the wrap of the movable scroll has an inclined portion of which a height gradually decreases toward a winding end point P2 in an area from a point P1 at which a line L1 extending outward from a center of a spiral base circle through an outer wall extension start point intersects an outermost wrap to the winding end point P2, the inclined portion of the wrap of the movable scroll comprises a first inclined portion, a flat portion, and a second inclined portion, a height of the first inclined portion gradually decreases from a start point of the first inclined portion toward an end point of the first inclined portion, a height of the flat portion does not change from a start point of the flat portion to an end point of the flat portion, a height of the second inclined portion gradually decreases from a start point of the second inclined portion toward the winding end point P2, the first inclined portion, the flat portion, and the second inclined portion are continuously formed in the wrap of the movable scroll in the area, and the height of the end point of the first inclined portion is lower than the height of the start point of the first inclined portion by 10 μm, and the height of the winding end point P2 of the second inclined portion is lower than the height of the start point of the first inclined portion by 50 μm.

2. The scroll compressor according to claim 1, wherein both the scrolls are plated.

3. The scroll compressor according to claim 1, wherein a back pressure chamber is formed in a back of the end plate of the movable scroll, and a back pressure hole causing the back pressure chamber and the compression chamber to communicate with each other is formed so as to penetrate the end plate of the movable scroll.

4. The scroll compressor according to claim 1, wherein no tip seal is provided at distal ends of the wraps of the fixed scroll and the movable scroll.

5. A scroll compressor comprising a compression mechanism including a fixed scroll comprising a disk-shaped end plate and a spiral wrap on a face of the disk-shaped end plate of the fixed scroll and a movable scroll comprising a disk-shaped end plate and a spiral wrap opposing the spiral wrap of the fixed scroll on a face of the disk-shaped end plate of the movable scroll, wherein the movable scroll revolves relative to the fixed scroll and a compression chamber formed between the wraps of both the scrolls is narrowed while moving from an outside to an inside, thereby compressing working fluid, the wrap of the movable scroll has an inclined portion of which a height gradually decreases toward a winding end point P2 in an area from a point P1 at which a line L1 extending outward from a center of a spiral base circle through an outer wall extension start point intersects an outermost wrap to the winding end point P2, the inclined portion of the wrap of the movable scroll comprises a first inclined portion, a flat portion, and a second inclined portion, a height of the first inclined portion gradually decreases from a start point of the first inclined portion toward an end point of the first inclined portion, a height of the flat portion does not change from a start point of the flat portion to an end point of the flat portion, a height of the second inclined portion gradually decreases from a start point of the second inclined portion toward the winding end point P2, the first inclined portion, the flat portion, and the second inclined portion are continuously formed in the wrap of the movable scroll in the area, and a length of the wrap of the movable scroll is set to be longer in the flat portion than in the first inclined portion and to be longer in the second inclined portion than in the flat portion.

* * * * *